US008051726B2

(12) United States Patent
Blackwood

(10) Patent No.: US 8,051,726 B2
(45) Date of Patent: Nov. 8, 2011

(54) LIQUID HANDLING EQUIPMENT

(76) Inventor: Miles Blackwood, Buderim (AU)

( * ) Notice: Subject to any disclaimer, the term of this patent is extended or adjusted under 35 U.S.C. 154(b) by 131 days.

(21) Appl. No.: 12/083,700

(22) PCT Filed: Aug. 25, 2006

(86) PCT No.: PCT/AU2006/001223
§ 371 (c)(1),
(2), (4) Date: Feb. 20, 2008

(87) PCT Pub. No.: WO2007/022583
PCT Pub. Date: Mar. 1, 2007

(65) Prior Publication Data

US 2010/0192707 A1 Aug. 5, 2010

(30) Foreign Application Priority Data

Aug. 26, 2005 (AU) ..... 2005905018

(51) Int. Cl.
*B01L 3/02* (2006.01)

(52) U.S. Cl. ..... 73/864.01

(58) Field of Classification Search ..... 73/864.01, 73/864.13
See application file for complete search history.

(56) References Cited

U.S. PATENT DOCUMENTS 4,098,125 A * 7/1978 Lee ..... 73/864.13

FOREIGN PATENT DOCUMENTS

EP 494735 A2 * 7/1992

* cited by examiner

*Primary Examiner* — Hezron E Williams
*Assistant Examiner* — Tamiko Bellamy
(74) *Attorney, Agent, or Firm* — Kilpatrick Townsend & Stockton LLP.; M. Henry Heines

(57) ABSTRACT

A pipette [1] is equipped with a jet [10] and handpiece [6]. A piston assembly, housed within the pipette [1], at one end has a seal [9] affixed to a rigid section [2] which extends to a flexible section [4]. At the junction of the rigid [2] and flexible [4] sections is an enlarged shoulder [7]. The flexible section [4] extends through the handpiece [6]. A movable sleeve [3] is positioned between the flexible section [4] of the piston rod assembly and the interior wall [11] of the pipette. At one end, the sleeve [3] passes over the shoulder [7] of the piston assembly and terminates in a constriction [8]. The other end of the sleeve [3] extends from the open end of the pipette [1] and terminates in a shoulder [5] of an external diameter greater than the bore diameter of the pipette [1].

12 Claims, 1 Drawing Sheet

LIQUID HANDLING EQUIPMENT

Figure 1:
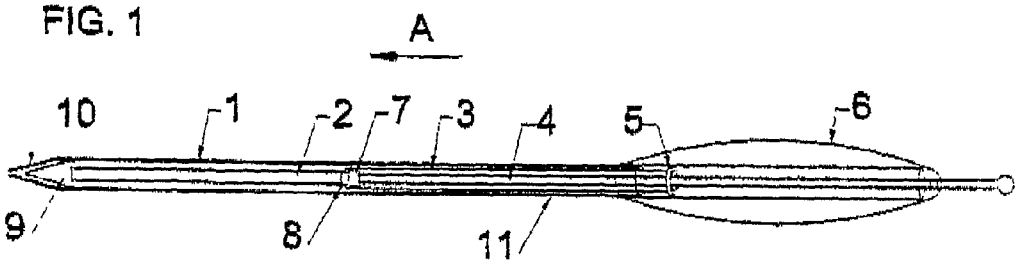

THIS INVENTION relates to a dispensing device. In particular, it is directed to a pipette of the type that dispenses liquid from the bore of the pipette with the aid of a piston.

A pipette is generally characterized by a slender cylindrical shaped hollow body with a conical taper (the 'jet') leading to a small aperture at the dispensing end, the other end being generally open. Some types of pipette incorporate a piston, slidable in the bore and manually operated for control of the liquid handling process. The piston is equipped with a piston head at the dispensing end and extends from the open, non-dispensing, end of the pipette where it is operated by the thumb. Piston movement is usually achieved with the aid of a handpiece arranged to facilitate the application of the thumb to the piston rod. When the piston rod is drawn up towards the open end of the pipette, for example when filling with liquid, it may protrude from the pipette approximately 250 mm. To prevent the piston rod being unwieldy where it protrudes from the pipette or handpiece, the piston rod can be made of a flexible material and be formed so the part of the rod protruding from the pipette at least partially curls.

However, one disadvantage of this flexible quality of the piston rod is that the rod can also flex when it is operating inside the pipette bore, touching the internal surface of the pipette and thus coming into contact with residual liquid left on the wall of the pipette; this liquid transferred from the wall of the pipette to the piston rod can then be passed to the thumb or finger of a user of the pipette as the rod is withdrawn. Solving this problem by providing a piston rod manufactured from a suitable stiffer material may not always be desirable because the protruding end of the piston rod returns the rod to being unwieldy when the rod is drawn towards the open end of the pipette. Further, the slender nature of pipettes, particularly in the smaller sized bores, demands that the piston rod is of a diameter which is inadequate to provide the necessary stiffness to prevent the piston rod touching the wall of the pipette during dispensing of a liquid from, the pipette.

It is thus a general object of the present invention to overcome, or at least ameliorate, one or more of the above-mentioned disadvantages.

The present invention at least ameliorates the above-mentioned disadvantages by providing a piston rod assembly having a sleeved construction able to shield parts operating within the sleeve from dangerous liquid residues present on the interior wall of the dispensing pipette.

According to a first aspect of the present invention, there is provided a pipette of the type having a hollow tubular body open at one end and having a dispensing jet at its other end whereby contents of said pipette are dispensed by the reversible operation of a piston-type rod within said body, said pipette characterised in that:

a movable sleeve is within said body, said rod passing through said sleeve, said rod being adapted to reversibly engage and move said sleeve in either direction required when said pipette is in use such that, during said use, a section of said rod remains continually enclosed by said sleeve.

Said section of said rod may be rigid or flexible,

Preferably, said section includes an enlarged shoulder adapted such that said sleeve can pass over said shoulder, said sleeve terminating in a constriction.

In those embodiments where said section of said rod is flexible, that said flexible section may be affixed to a rigid section.

In those embodiments where said section of said rod is flexible, said enlarged shoulder is at the junction of said flexible section and said rigid section.

One end of said sleeve may extend from the open end of said pipette to terminate in a shoulder of an external diameter greater than the bore diameter of said pipette.

Said pipette may include a handpiece to facilitate its use.

Said handpiece may include a bore through which said section can extend adapted to contain said movable sleeve with its said shoulder.

Said handpiece may include two essentially concentric bores, the first bore to accommodate said section and a larger diameter second bore to contain said sleeve with its shoulder.

Said rod may include a second flexible section which is adapted to curl when said second section is extended from said one end of said pipette.

Said sleeve may be a telescopic assembly.

Said rod may be a telescopic assembly.

As a second aspect of the present invention, there is provided a method of substantially reducing the likelihood of an operator of a pipette from contacting any residual liquid held within said pipette after its use, said method including the use of a pipette as hereinbefore described.

Figure 2:
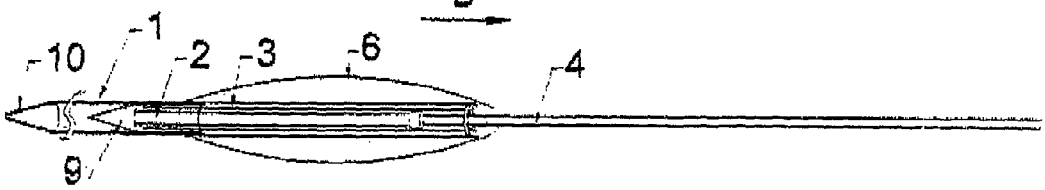

A preferred embodiment of the present invention will now be described with reference to the accompanying drawings, wherein;

FIG. 1 illustrates, in cross-section, a pipette according to the present invention in a position which has fully dispensed liquid from the pipette; and FIG. 2 illustrates, in cross-section, the pipette of FIG. 1 in a partially retracted position to draw liquid into the pipette.

With reference to FIGS. 1 and 2, a pipette [1] is equipped with a jet [10] and handpiece [6] as is well known in the art. A piston assembly, housed within the pipette [1], at one end has a seal [9], well known in the art, affixed to a rigid section [2] which extends to a flexible section [4]. At the junction of the rigid [2] and flexible [4] sections is an enlarged shoulder [7]. The flexible section [4] extends through the handpiece [6] to enable an operator to hold the pipette [1] and operate the piston assembly. A movable sleeve [3] is positioned between the flexible section [4] of the piston rod assembly and the interior wall [11] of the pipette. At one end, the sleeve [3] passes over the shoulder [7] of the piston assembly and terminates in a constriction [8]. The other end of the sleeve [3] extends from the open end of the pipette [1] and terminates in a shoulder [5] of an external diameter greater than the bore diameter of the pipette [1]. The bore within the handpiece [6] through which the flexible section [4] can extend is also of dimensions sufficient to contain the movable sleeve [3] with its shoulder [5]. Alternatively, there can be two essentially concentric bores within the hand piece [6], the first to accommodate the flexible section [4] and a larger diameter bore to contain the sleeve [3] with its shoulder [5].

In use, to expel liquid held In the pipette [1] [FIG. 1], a force is applied to the piston rod assembly in the direction [A] to move the assembly towards the pipette jet [10], As the flexible section [4] continues to move towards the jet [10], the shoulder [7] of the piston assembly engages the constriction [8] of the movable sleeve [3] withdrawing the sleeve [3] from the handpiece [6] and positioning the sleeve [3] between the flexible section [4] and the interior wall [11] of the pipette [1]. As the sleeve [3] continues to move within the pipette [1], its shoulder [5] engages the open end of the pipette [1] to terminate that movement. The dimensions of the various components of the pipette [1] are such that, at the point when movement of the sleeve [3] in the direction A is terminated, the seal [9] is seated fully within the jet [10] to expel substantially all of the contents of the pipette [1], thereby ensuring that the sleeve [3] is always between the flexible section [4] and the interior wall [11] of the pipette [1] and thus isolating the flexible section [4] of the piston assembly from any liquid that may be remaining on the interior wall [11] of the pipette [1].

To then place liquid within the pipette [1] [FIG. 2], a force in the direction [B] is applied to the piston rod assembly to move the piston assembly away from the pipette jet [10]. As the flexible section [4] continues to move away from the jet [10], the seal [9] engages the movable sleeve [3] which can be moved until the sleeve [3] is contained within the handpiece [6], this movement, thus once again, ensuring that the sleeve [3] is always between the flexible section [4] and the interior wall [11] of the pipette [1] isolating the flexible section [4] of the piston assembly from any liquid that may be on the interior wall [11] of the pipette [1].

The present invention therefore provides a pipette with a piston rod for dispensing liquid from the pipette but which isolates the user from any residual liquids that may be present within the pipette bore as the rod is withdrawn.

It will be appreciated that the above described embodiment is only an exemplification of the various aspects of the present invention and that modifications and alterations can be made thereto without departing from the inventive concept as defined in the following claims.

The invention claimed is:

1. A pipette of the type having a hollow tubular body open at one end and having a dispensing jet at its other end whereby contents of said pipette are dispensed by the reversible operation of a piston-type rod within said body; said pipette characterized in that:

a movable sleeve is within said body, said rod passing through said sleeve, said rod being adapted to reversibly engage and move said sleeve in either direction required when said pipette is in use such that, during said use, a section of said rod remains continually enclosed by said sleeve.

2. A pipette as defined in claim 1 wherein, said section includes an enlarged shoulder adapted such that said sleeve can pass over said shoulder, said sleeve terminating in a constriction.

3. A pipette as defined in claim 1 or claim 2 wherein, said section of said rod is flexible.

4. A pipette as defined in claim 1 or claim 2 wherein, said section of said rod is flexible and is affixed to a rigid section.

5. A pipette as defined in claim 2 wherein, said section of said rod is flexible and is affixed to a rigid section, and said enlarged shoulder is at the junction of said flexible section and said rigid section.

6. A pipette as defined in any one of claim 1 wherein, one end of said sleeve extends from said open end of said pipette to terminate in a shoulder of an external diameter greater than the bore diameter of said pipette.

7. A pipette as defined in claim 1 which includes a handpiece to facilitate use of said pipette.

8. A pipette as defined in claim 7 wherein, said handpiece includes a bore through which said section can extend adapted to contain said movable sleeve.

9. A pipette as defined in claim 7 wherein, said handpiece includes two essentially concentric bores, the first bore to accommodate said section and a larger diameter second bore to contain said movable sleeve.

10. A pipette as defined in claim 1 wherein, said rod includes a second flexible section which is adapted to curl when said second section is extended from said one end of said pipette.

11. A pipette as defined in claim 1 wherein, said sleeve has a telescopic assembly.

12. A pipette as defined in claim 1 wherein, said rod is a telescopic assembly.

* * * * *